United States Patent [19]

Smith, Jr.

[11] 4,373,733

[45] Feb. 15, 1983

[54] REACTIONARY HUMAN SILHOUETTE TARGET

[76] Inventor: Marvin F. Smith, Jr., P.O. Box 832, Willcox, Ariz. 85643

[21] Appl. No.: 263,151

[22] Filed: May 13, 1981

[51] Int. Cl.[3] ..... F41J 5/00; F41J 5/06

[52] U.S. Cl. ..... 273/381; 273/386; 273/392

[58] Field of Search ..... 273/375, 381, 386, 390, 273/391, 392, 55 A; 276/76

[56] References Cited

U.S. PATENT DOCUMENTS

| | | | |
|---|---|---|---|
| 741,131 | 10/1903 | Hanson | 273/390 X |
| 906,392 | 12/1908 | Dietz . | |
| 927,631 | 7/1909 | Bennett | 273/390 |
| 994,986 | 6/1911 | Dimick | 273/391 X |
| 2,130,558 | 9/1938 | Murray | 273/390 X |
| 2,890,052 | 6/1959 | Burrell | 273/375 |
| 3,844,559 | 10/1974 | Davidson | 273/391 X |

OTHER PUBLICATIONS

The American Rifleman, May 1977, pp. 25, 26.

*Primary Examiner*—Anton O. Oechsle
*Attorney, Agent, or Firm*—J. Michael McClanahan

[57] ABSTRACT

A reactionary human silhouette targer for shooters is disclosed which gives instantaneous visual and audible reaction to being struck whereby by watching the target and listening, the area of the target which is struck may be determined. The target comprises the upper torso and arms of a person with a body-like front contour, the target mounted on an upright stand. In connecting the target to the stand, a four directional pivot means is provided, together with means to return the target to its original position once moved, the target reacting by pivoting in the direction in which it is struck, and for the instant of being struck in a central target area, the target then raises vertically. Additionally, indication by a different sounding noise is given for different portions of the target being struck.

7 Claims, 6 Drawing Figures

REACTIONARY HUMAN SILHOUETTE TARGET

BACKGROUND OF THE INVENTION

In the field of targets for shooters, it has long been a goal to have a target which, in addition to presenting a preferred striking area, will give an indication of where the target has been struck. One example of this is the paper or cardboard "Bullseye" type target, however, because in most cases, the bullets which strike the target are rather small in comparison to the target and especially in relationship to the distance between the target and the shooter, either the shooter must walk up to the target to inspect it or be equipped with rather powerful binoculars for observation. One very apparent disadvantage of the "Bullseye" type target, is the fact that the target becomes progressively destroyed as it is being used.

Now there have been targets of sorts which have been developed which do give reactions when struck, for example, Hanson, in U.S. Pat. No. 741,131, illustrates a human-like structure which stands on a platform to receive the fired bullets and when the bullet penetrates a centrally located opening in the human-like target, the target falls backwards and lays upon the ground. One obvious disadvantage of this type of target is it is necessary to hit the specific set-out target area in order to obtain an indication of being hit, and that being hit around the specific target area, but still upon the human-like target, does not give any indication. In addition, the target must be manually returned to an upright position.

Another human-like target which is in the art is the summy for military practice invented by Dietz and shown in U.S. Pat. No. 906,392. Here a human-like torso is suspended upon a rod emminating from the ground, the rod being characterized by a spring wrapped around a portion of the upright rod. In this situation, the human-like figure is free to bend in any direction and return to an upright position when the displacing force is removed. The target is intended for use of weapons of war such as the lance, the sword, and the bayonet.

One obvious disadvantage of the Dietz device is that once the target has been displaced from its normal resting position, the target will proceed to oscilate back and forth until all of the energy has been dissipated in the return spring. Therefore, it is not immediately ready for the next reaction until the oscillations have ceased. This is the reason that it was used primarily for direct engagement by the lance, the sword, or the bayonet since the time between successive strikes or attacks from these types of weapons is much greater than being struck by a person firing a handgun or a rifle as fast as they might at the target.

Other types of targets are known which perform a function of rotating backwards when hit and then either returning to an upright position or remaining knocked back until reset. Examples of these types of targets are found in Bennett, U.S. Pat. No. 927,631; Dimick, U.S. Pat. No. 994,986; and Davidson et al, U.S. Pat. No. 3,844,559.

Obviously, there is a need for a shooters' target which gives an immediate visual and audio reaction to being struck by the shooters' bullets, as well as to have a reaction time and time to return to initial original position so swift that the target is useful in fast shooting situations.

SUMMARY OF THE INVENTION

The subject invention discloses a reactionary type human silhouette target which gives immediate reaction to being struck by a bullet from a handgun or rifle, dipping or pivoting in the direction which it was struck and then returning immediately to its front forward position ready to receive the following shot. The target in addition, will give different pitched audible retort when stuck. If the target is struck in its center area, the target then will move upward and then downward, rather than dipping or turning, and will give a different pitched audible sound.

More specifically, the subject invention comprises the upper torso of a human-like figure having a centrally located main target area in the chest with a secondary target area in the head, the target contoured similarily to the front of a human.

The human-like reactionary type target is pivotal by means attached immediately behind the target in the central target area which allows movement, front and back, side to side, and up and down. The target is immediately returned with very little overshoot to its orginal position by means of elastic straps fastened to the backside which assure immediate response.

Finally, the target is mounted in the air by its pivotal means, at approximate human height, by placement upon a post rising from a base resting on the ground.

In addition, the device may be adapted to receive animal-type silhouettes which give the same indication as the human silhouette, moving in accordance with the area being struck and giving different sounds, and then returning to its original position.

Accordingly, it is an object of the subject invention to provide a human-type reactionary target which responds instantaneously to being struck by a bullet, the response by its nature and sound illustrating the area which the target is struck.

It is another object of the subject invention to provide a reactionary human-type silhouette target which, after being struck and giving visual and audible indication of being struck, returns immediately to its front rest position.

It is still a further object of the subject invention to provide a reactionary type target for animals and the like which is fast responding, giving immediate visual and audible reaction to being struck.

DETAILED DESCRIPTION OF THE PREFERRED EMBODIMENT

Figure 1:
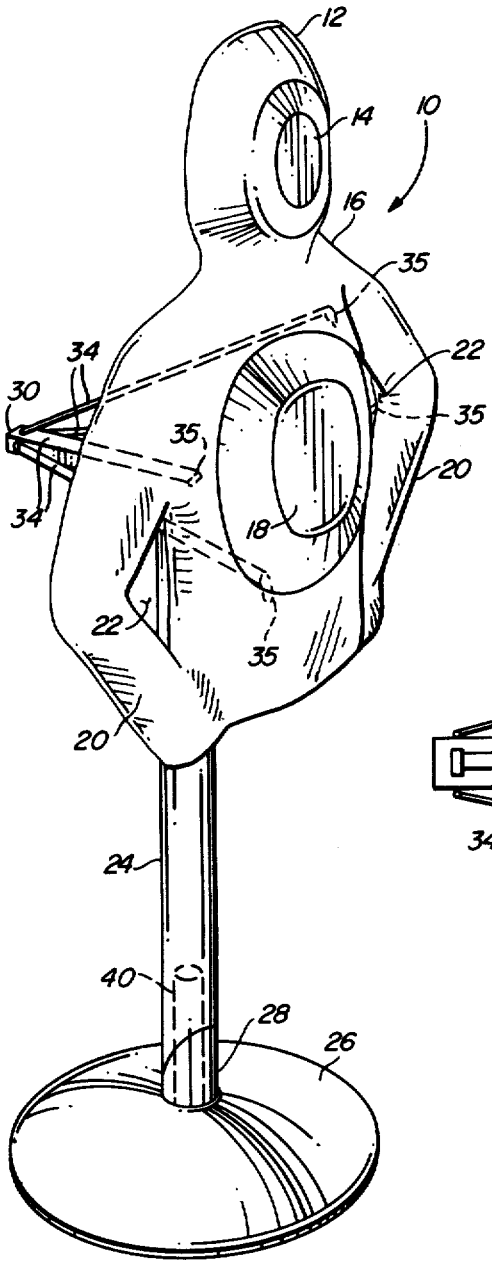
FIG. 1 is a perspective view of the subject reactionary type human silhouette target.

Referring now to FIG. 1, a perspective view of the reactionary human silhouette target is detailed. As can been seen, the silhouette target 10 takes the appearance of a person from the waist up which, when being used, is intended to face the shooter. Upon the silhouette have been marked by painting or other means, oval shaped targets for the shooter, nominally one in the central chest area of the silhouette and another in the head area. This silhouette which is shown is, like the human it resembles, rounded or contoured slightly from side to side and to some extent from the top and the bottom. The central area which forms the center of the target area presents the part of the silhouette protruding the greatest in relationship to the surrounding target.

In the preferred embodiment, a ⅜ inch AR-225 hardness steel plate is utilized with the roundness of the target formed through means of an 85-ton press.

The silhouette target 10 comprising the head 12 with its centrally located target area 14 is connected by the neck to the shoulders and chest area of the target main body 16 which in turn has a centrally located target area 18. The silhouette is so shaped to show the arms 20 of the person's image with cutouts 22 between the arms and the chest area.

Connected by means discussed later, the silhouette target is suspended upon post 24 which in turn rests upon short pipe 28 welded to base 26. The exact means by which the post 24 interconnects with the base 26 and short pipe 28 is later detailed. Base 28 is preferrably formed of metal, usually steel, as if the post 24 and short pipe 28. It is anticipated that the base be weighted and of sufficient diameter to resist the silhouette target 10 from being turned over.

Shown additionally on FIG. 1 in dotted form is the attachment points 35 to which the elastic straps 34 (FIG. 2) attach. It is noted that the upper and the lower elastic straps 34 attach at their attachment points slightly off center since it is necessary to avoid the lower elastic strap 34 touching the post 24. Upon the sides however, the elastic straps attachment points 35 are directly in line with the point of the line hold 44 found in pivot block 42 (FIG. 3).

Figure 2:
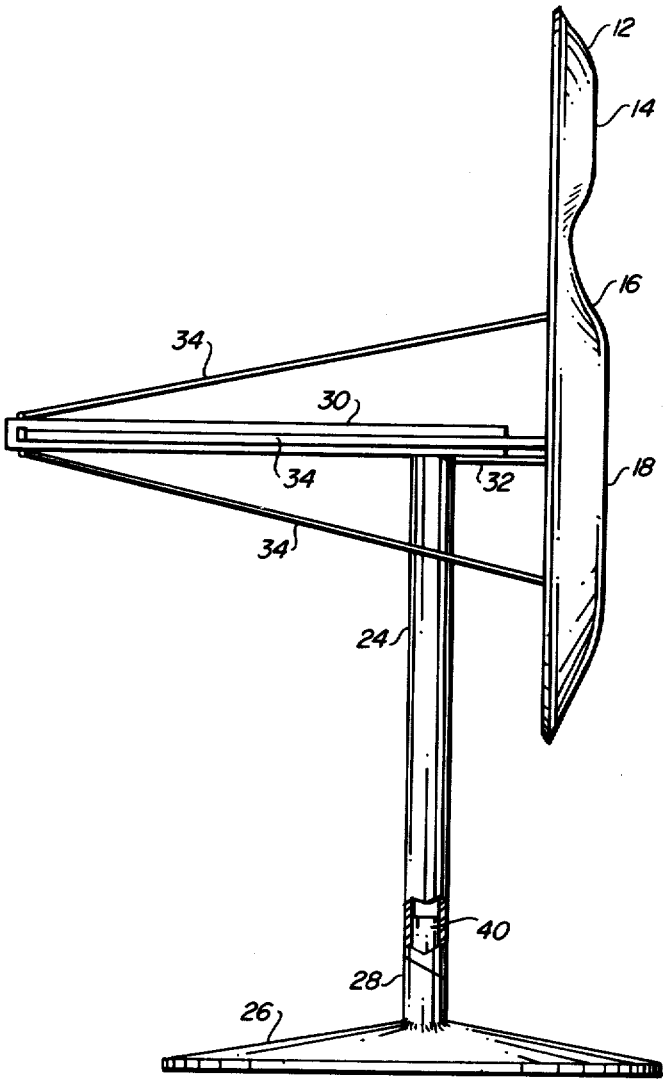
FIG. 2 is a side view of the subject reactionary type human silhouette target.

Referring now to FIG. 2, a side view of the subject reactionary human silhouette is shown. The side view shows the roundedness of the silhouette target 10 and additionally shows how the silhouette target 10 is suspended with relationship to post 24. Firstly, post 24 is welded to cross-piece 30, nominally a 2 inch or so diameter steel pipe. Then welded to the underside of cross-piece 30 abutting post 24 is rod 32 which engages the silhouette target 10 as later detailed. Engaging silhouette target 10 at four points and connecting to the distal end of cross-piece 30 are four elastic straps 34. Three straps are shown in the Figure, the fourth strap being hidden behind the centrally located strap 34. These four straps connect at one end to four holes drilled at the end of cross-piece 30, and at the other end to the attachment points 35 on silhouette target 10.

As earlier stated, the silhouette target 10 is supported ultimately by the base 26 which has short pipe piece 28 welded to it. In the arrangement in the invention, short pipe piece 28 is cut at an angle and is the same size as post 24. Then welded interiorly, and centrally to short pipe piece 28 is a third pipe 40 (shown in dotted form) which also nests interiorly to the inside diameter of post 24. The end of post 24 is also cut at a matching angle as is short pipe 28, and the two pipes joined over inside pipe 40. Thus, post 24 is held in a rigid, non-turning position over inside pipe 40, and against short pipe 28. Also, through this arrangement, the base may be readily separated from post 24 for easy transportability.

Figure 3:
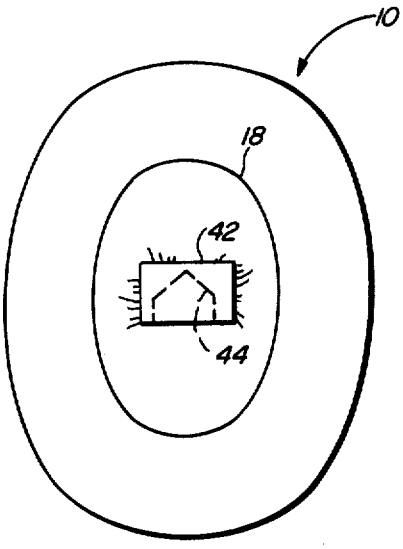
FIG. 3 is a back view of the central target area of the subject reactionary type human silhouette target.

Referring now to FIG. 3, a view from the back of the silhouette target 10 is shown encompassing primarily the outer and inner portion of the silhouette target 18. Located centrally to the oval target area 18 is pivot block 42, pivot block 42 being attached to the silhouette target 10 by welding around its four sides. Shown in dotted form internally to pivot block 42 is the drilled blind hold 44, which in the preferred embodiment has a diameter of 1½ inches. In the preferred embodiment, the vertical wall depth of the blind hole is approximately 1 inch with the angle of the drill point being 60° on each side of the vertical.

It is noted that the location of the pivot block 42 is approximately in the center of the central target area 18, which may also be known as the kill or fatal zone. Note however, that this is not the weight center of the silhouette target 10. It has been found that for the silhouette to hand vertically, the weight center should be slightly below pivot block 42. In addition, the thickness of the pivot block 42, or more importantly, the location of the bottom of the drilled blind hole 44 relative to the depth at which the silhouette target is contoured from the outermost edge which lies in a flat plane is also critical in order for the figure to hang straight. Otherwise, there will be a tendency for the silhouette target to lean forward or backward. While the elastic straps 34 do help to keep the silhouette target maintained correctly upright, it is not intended that these elastic straps shall correct any large, out of balance portions, but, as later explained, assist the shooter in determining where his bullet hit the target. The elastic straps 34, in their resting position, are preferably under zero tension.

Figure 4:
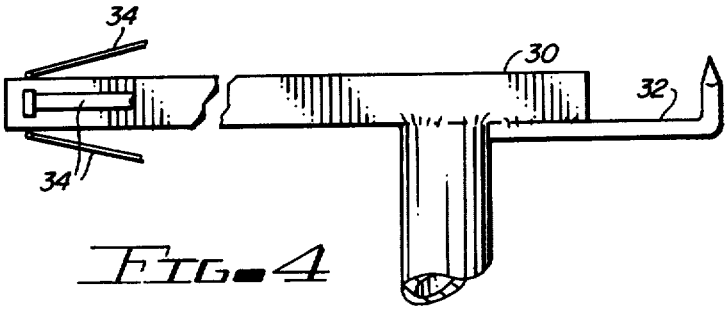
FIG. 4 is a side view of the means by which the target is suspended.

Referring now to FIG. 4, a side view of the junction of post 24, cross-pipe 30, and rod 32 is detailed. As earlier stated, all three members are joined together by welding. Shown in FIG. 4 is that portion which has not been earlier shown, namely the end of rod 32 which engages blind hole 44 of pivot block 42. Rod 32, which nominally is a ¾ inch diameter steel rod, has near its end, a 90° upturn to the point where the rod is terminated in a sharpened turned point, the angle of the point sides being 30° from the vertical.

As earlier explained, the blind hole point sides are 60° from the vertical so that there is a difference of 30° between the angled tip of rod 32 and the inside point of blind hole 44 when blind hole 44 is encompassing the point of rod 32. The reason for this will be explained in FIG. 5 which is the next illustration.

Figure 5:
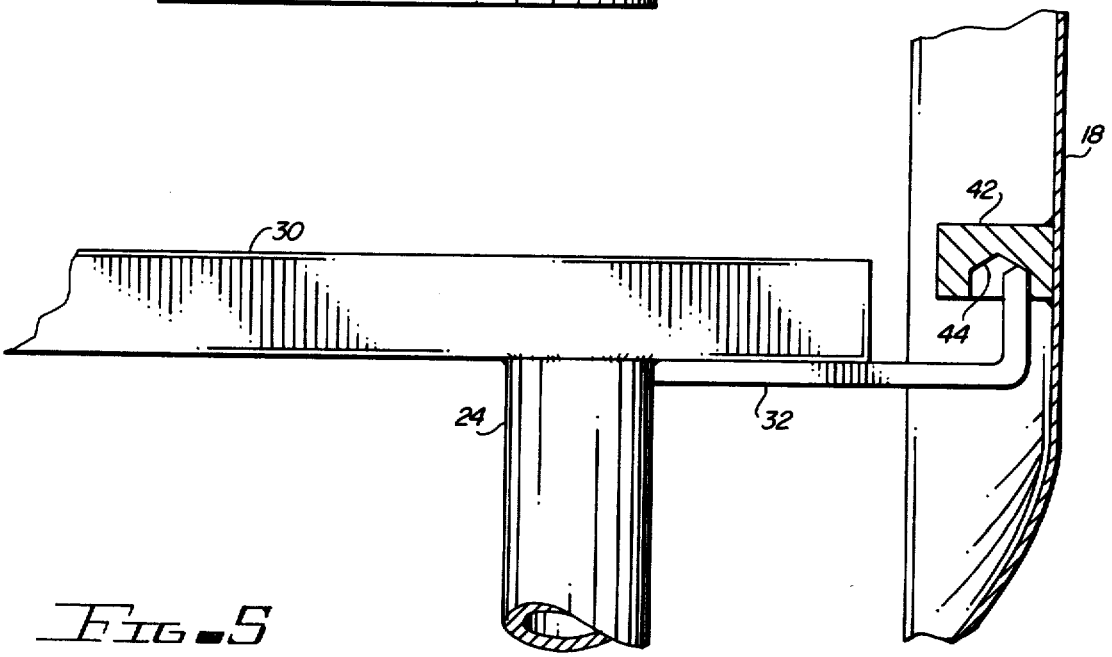
FIG. 5 is a cross-sectional view of the means suspending the target together with the means on the target.

Referring now to FIG. 5, a cross-sectional view is taken with the silhouette target in place upon the rod 32 showing in cross-section post 24, cross-piece 30, rod 32, pivot block 42, blind hole 44, and a portion of the target area 18 which is welded to pivot block 42.

The drawing shown in FIG. 5 illustrates the target at a particular time in its usage when a bullet has struck the silhouette target 10 in the area of target 18. In this case, the energy transferred from the striking bullet to the silhouette target 10 has caused the silhouette target 10 to move backwards which causes the silhouette target to ride upward on the point and edge formed on rod 32. The silhouette target will continue to ride backwards and upwards until the side of blind hole 42 engages the upright 90° portion of rod 32 at which time any energy remaining in the silhouette target 10 is transferred to the cross-piece 30 and post 24.

In practice, the reactionary human silhouette target 10 works as follows. As the target is struck by a bullet from a rifle or a handgun, if the bullet strikes the head area or any of the peripheral areas surrounding the upper central portion, the target will react by dipping backwards a noticable amount. The target then will, through the means of the elastic straps 34, return to its central position with no noticable overshoot, and with the little that may be there, dampening out very rapidly. Similarily, if the silhouette target 10 is hit by a bullet in the peripheral area below the central target area 18, the silhouette target 10 will tip forward. As is obvious then, if the silhouette target 10 is hit on either horizontal side of the central target area 18, the silhouette target 10 then will move in the direction in which it is hit.

Thus, immediate indication is given to the shooter of where his bullets are striking the silhouette target 10 when the area struck is in one of the peripheral areas away from the central target 18. In addition of course, the bullet striking the silhouette target 10 does make an audible sound which is detected for a considerable distance.

Now when the shooter hits the centrally located target area 18 and its immediate surrounding area, the target will not dip since it is in line with the holding medium, i.e., rod 32 and its connecting cross-piece 30 and post 24. However, as earlier explained, the target will ride slightly up. This is noticable to the shooter, however, the shooter will plainly hear the silhouette target 10 being struck, which upon his viewing same, if it does not move, means that he has hit the central area where he aimed. In addition, the sound of the bullet hitting the central target area 18 will be of lower pitch than the sound of surrounding areas being struck.

Now it is obvious that other shapes can be applied to the reactionary silhouette target 10 which has been shown in the Drawings 1 through 5. For example, FIG. 6 details an animal, such as a coyote or wolf, may be used as the targeted object.

Figure 6:
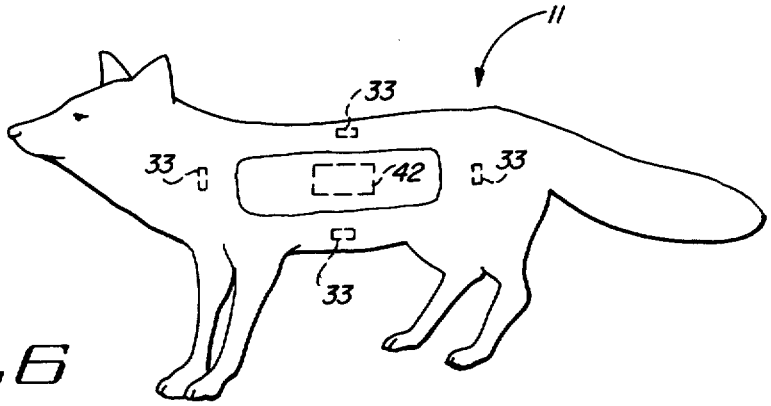
FIG. 6 is an alternate embodiment showing a reactionary type animal silhouette target.

Referring now to FIG. 6, a silhouette 11 of a coyote is shown where in is centrally located and shown in dotted form the outline of the pivot block 42. This of course is also located in the central target area. Also shown in dotted form are the points of attachment 33 at which the elastic straps 34 attach to the back side of the silhouette target 11 of a coyote. These points of attachment 33 are shown at the head and tail ends of the coyote, as well as the lower stomach and upper back area. It is obvious, unlike the reactionary human silhouette target 10, that these elastic straps should be of two different types, the straps attaching to the attachments 33 at the head and tail ends of the silhouette target 11 being rather strong elastic straps requiring more striking energy to stretch the straps, while the two straps on the top of the back and the bottom of the belly would necessarily be rather weak elastic straps. The reason for the strong and the weak elastic straps respectively is obvious, as the distance from the pivot point internal to pivot block 42 is longer by a considerable amount for the tail end and head end of the coyote then it is for the area at the top of the back or bottom of the stomach. Otherwise, a bullet striking either end of the animal would tend to produce a very great and out of proportion reaction because of the distance from the fulcrum that pivot block 42 as compared with the bullet striking at the top of the back or lower portion of the belly.

While the preferred embodiment of the invention has been shown and described, together with an alternate embodiment, it will be understood that there is no intent to limit the invention by such disclosure, but rather it is intended to cover all modifications and alternate constructions falling within the spirit and the scope of the invention as defined in the appended claims.

I claim:

1. A target for shooters which gives specific indication of where struck when struck at different locations by a bullet comprising a defined silhouette type target of a durable material, a stand resting on the ground, and pivotal means interposed between said silhouette type target and said stand, said pivotal means attached to said silhouette type target generally in the central area thereof, said pivotal means adapted to permit deflection by said silhouette type target to either side, top, or bottom in response to a hit remote from said central area, and said pivotal means also adapted to permit the silhouette type target to move in a straight line away from and upward from the shooter in response to a hit in said central area, whereby said pivotal means permits the target when struck, to deflect or move indicative of where struck, including the central area, the target being responsive at the location where struck with movement carrying through the momentum transferred by the striking bullet.

2. The target for shooters as defined in claim 1 further including means to return the silhouette type target to its initial position after being struck and deflected.

3. The target for shooters as defined in claim 2 wherein said means to return the target to its initial position after being struck also defines means to prevent oscillations of the target after being returned to its initial position.

4. The target for shooters as defined in claim 2 wherein said pivotal means defines a block of material attached to said silhouette type target, said block of material having a blind hole drilled therein, terminating in a beveled point, and said stand includes a horizontally protruding rod, the tip of said rod upturned and terminating in a sharp point, said sharpened point adapted to enter the blind hole of said block with the point of sharpened rod engaging the beveled drill hole point in said block.

5. A target for shooters as defined in claim 4 wherein said means to return the target to its initial position defines elastic members, said one end of said elastic members attached to said silhouette type target and the other end of said elastic member attached to said stand.

6. The target for shooters as defined in claim 5 wherein said stand comprises a base, a post attached at one end to said base, and the horizontally protruding rod attached to the post's other end whereby said base and post holds the silhouette type target off the ground.

7. The target for shooters as defined in claim 6 wherein said silhouette type target comprises a target formed of steel, said target contoured to represent a character.

* * * * *